US005558676A

United States Patent [19]

Gray et al.

[11] Patent Number: 5,558,676

[45] Date of Patent: Sep. 24, 1996

[54] COMPOSITION AND A METHOD FOR TREATING GARMENTS WITH THE COMPOSITION

[75] Inventors: Donnie R. Gray, Dilley; Glen A. Dickson, St. Hedwig, both of Tex.

[73] Assignee: Ocean Wash, Inc., Dilley, Tex.

[21] Appl. No.: 404,520

[22] Filed: Mar. 15, 1995

[51] Int. Cl.[6] ..... D06L 3/02; D06L 3/08

[52] U.S. Cl. ..... 8/107; 8/102; 8/108.1; 8/110; 8/111

[58] Field of Search ..... 8/102, 107, 108.1, 8/110, 111; 252/8.6, 95, 100, 103, 105, 315.01, 315.1, 315.2, 315.5, 186.35, 186.36, 186.37, 187.1, 187.23, 187.24, 187.25, 187.26, 187.28, 187.31, 187.34, 186.1, 186.33

[56] References Cited

U.S. PATENT DOCUMENTS

| | | | |
|---|---|---|---|
| 1,659,598 | 2/1928 | Funk . | |
| 3,575,865 | 4/1971 | Burke et al. . | |
| 3,639,248 | 2/1972 | Moyer et al. . | |
| 3,676,341 | 7/1972 | Gerecht et al. . | |
| 3,715,314 | 2/1973 | Morgenstern . | |
| 3,977,980 | 8/1976 | Fry et al. . | |
| 4,116,851 | 9/1978 | Rupe et al. . | |
| 4,193,888 | 3/1980 | McHugh . | |
| 4,347,153 | 8/1982 | Hooper et al. . | |
| 4,352,678 | 10/1982 | Jones et al. . | |
| 4,386,992 | 6/1983 | Takegawa et al. . | |
| 4,387,107 | 6/1983 | Klein et al. . | |
| 4,450,188 | 5/1984 | Kawasumi . | |
| 4,622,056 | 11/1986 | Matsuo et al. . | |
| 4,740,213 | 4/1988 | Ricci | 8/108.1 |
| 4,752,409 | 6/1988 | Drapier et al. | 252/94 |
| 4,900,323 | 2/1990 | Dickson et al. | 8/111 |
| 4,919,842 | 4/1990 | Dickson et al. . | |
| 4,954,138 | 9/1990 | Butcher et al. . | |
| 4,961,749 | 10/1990 | Clements . | |
| 4,961,751 | 10/1990 | Eissele et al. . | |
| 4,999,025 | 3/1991 | Patton | 8/102 |
| 5,006,124 | 4/1991 | Tieckelmann et al. . | |
| 5,053,306 | 10/1991 | El-Sayed et al. . | |
| 5,114,426 | 5/1992 | Milora et al. . | |
| 5,190,562 | 3/1993 | Dickson et al. . | |
| 5,213,581 | 5/1993 | Olson et al. . | |
| 5,215,543 | 6/1993 | Milora et al. . | |
| 5,441,541 | 8/1995 | Mehreteab et al. | 8/137 |

FOREIGN PATENT DOCUMENTS

| | | |
|---|---|---|
| 0177165 | 8/1985 | European Pat. Off. . |
| 0275432 | 12/1987 | European Pat. Off. . |
| 0288722 | 3/1988 | European Pat. Off. . |
| 0292178 | 5/1988 | European Pat. Off. . |

OTHER PUBLICATIONS

"Men's Jeans Take a 'Lite' Turn for '87", Daily News Record (NY), vol. 16, No. 159; Friday, Aug. 22, 1986 (2 pp.).

"Spinners, Knitters See Indigo Yarn Use Growing Despite Production Woes", Daily News Record (NY) (vol. & No. unknown); Wednesday, Sep. 11, 1986 (2 pp.).

"Denim's Trials and Tribulations", Manufacturing Clothier-Britain's Only Independent Clothing Trade Monthly, vol. 68, No. 9; Sep. 1987 (cover, index, 3–page article).

*Primary Examiner*—Prince Willis, Jr.
*Assistant Examiner*—Alan D. Diamond
*Attorney, Agent, or Firm*—Gunn, Lee & Miller, P.C.

[57] ABSTRACT

This invention relates to a composition for treating fabric or garments and a method for using the composition to treat the garments. The composition contains an oxidizer mixed with a gel or a thickening agent to form a liquid/solid colloidal suspension. The composition is inserted into a tumbler with garments and, typically, spreaders, such as short lengths of PVC pipe. Tumbling the composition with the spreaders allows the composition to be spread randomly over the garments to give them a faded or worn look.

13 Claims, No Drawings

COMPOSITION AND A METHOD FOR TREATING GARMENTS WITH THE COMPOSITION

FIELD OF THE INVENTION

This invention relates to a composition for treating fabric and a method for using the composition to treat fabric to produce a stone-washed, faded or distressed look, more specifically to a two-phase, colloidal suspension composition containing an oxidizing agent and a gelling or thickening agent, the oxidizing agent for reacting with a dye of the fabric and a method for using the gel composition for treatment of fabric to produce a stone-washed, distressed or faded look thereto.

BACKGROUND OF THE INVENTION

Recently, it has become fashionable to purchase new garments which have been treated by the manufacturer or a laundry to produce a worn, used, faded or distressed look. This is especially true for denim-based cotton fabric which is often treated before sale to produce a stone-washed look. That is, the garment is subject to a mechanical and/or chemical action or a combination of both to produce a faded, distressed or stone-washed look with random color variation in the panels and the seams of the garment. Typically, such a stone-washed look is formed by washing the garments in a liquid bath with an oxidizing agent along with pumice stone or synthetic stone.

Another example of a method of treating garments to produce a worn look is disclosed in Ricci, U.S. Pat. No. 4,740,213 where pumice is impregnated with an oxidizing agent such as sodium hypochlorite. These granules are tumbled with the garments to be treated in a rotating drum (not in a liquid bath) for a set period of time and then the oxidizing agent is neutralized by washing the garments. While this often produces a desirable look, sometimes called an "acid wash", there are numerous problems with this and the traditional stone-washed method, including problems with effluent, wear and tear on the machines and garments and the time consumed in treating the garments, both pre and post wash.

Garments, especially denim-based garments are occasionally treated in a liquid bleach bath to bring out or lighten up the fabric uniformly. Such treatment in a liquid bleach bath has been used in conjunction with both stone-wash and acid-wash treated garments. When stone or acid wash garments are treated in a liquid bleach bath, both the light areas and dark areas are uniformly brought out or lightened. That is, the use of bleaching out dye is well known for denim garments used either alone or in conjunction with other methods of treating garments.

Patents that address the problems set forth in treating garments with pumice or synthetic stones impregnated with an oxidizing agent to produce a stone-washed look include U.S. Pat. No. 5,215,543 (Milora et al. 1993) and U.S. Pat. No. 5,213,581 (Olsen et al. 1993). These two patents discuss at some length the problems associated with the traditional stone-wash method of treating garments.

Milora et al., address the various problems with the traditional stone-wash method of treating garments by providing compositions and methods wherein the integral masses of stones are provided having a chemical composition which is soluble in wash or rinse liquid for the fabric. The stones are of sufficient size and hardness to effect abrasion of the fabric without substantial disintegration of the pellets during tumbling in order to simulate the action of pumice stones.

Olsen addresses the problems by providing processes and compositions for obtaining a stone-wash, distressed or "used" look to clothing and utilizing compositions that are stone free by providing an aqueous composition containing amounts of a cellulase enzyme that can degrade cellulosic fabric and release the fabric dye or dyes.

Applicants' own patents to Dickson et al. U.S. Pat. Nos. 4,900,323; 4,919,842; and 5,190,562 disclose a bleaching composition for use in a non-aqueous method for fading denim fabric. U.S. Pat. No. 4,900,323 discloses a diatomaceous earth carrier for a bleaching composition, such as potassium permanganate, chlorine bleaches, and peroxygen bleaches. The non-aqueous method disclosed calls for tumbling the fabric with the bleaching composition.

U.S. Pat. No. 5,190,562 is a Continuation of U.S. Pat. No. 4,900,323 and also discloses a non-aqueous method for fading denim fabric. The bleaching composition in this later issued patent comprises a selected from feldspar, soda ash, sodium silicate, synthetic silica dioxides, calcium carbonate, sodium bicarbonate, sodium sequis carbonate, borax, and sodium sulfate, any of which are impregnated with potassium permanganate or other bleaching agent.

U.S. Pat. No. 4,919,842 discloses a bleaching composition prepared according to particular methods and comprising potassium permanganate, diatomaceous earth and water.

The above cited patents are simply a few of a number of patents related in the objective of producing a faded, distressed or stone-washed look to garments, typically denim or cotton garments, without the disadvantages set forth above.

SUMMARY OF THE INVENTION

Applicants' invention addresses the problems inherent in the traditional stone-wash method of treating garments to produce a faded or distressed look and further offers advantages of a unique, specific, desirable appearance for the finished fabric. Thus applicants' present invention provides a method of producing a faded or distressed look to garments. Applicants' present invention also provides a composition and method of use of a composition capable of treating garments to produce a faded or distressed look without damage to machines, waste-water problems, derocking problems and other problems associated with the prior art. Specifically, applicants' invention provides a two-phase, liquid/solid colloid, typically a gel composition, and method which results in a garment with a variety of looks dependant on a number of variables as more fully set forth herein as well as unique appearances which would be difficult to obtain with a liquid or a dry bleaching composition in either an aqueous or non-aqueous method.

Applicants typically utilize a gel composition containing an oxidizing agent and a gelling agent. The oxidizing agent can be selected from potassium permanganate, sodium hypochlorite, sodium chlorate, sodium chlorite, sodium permanganate, calcium hypochlorite, lithium hypochlorite, dichloroisocyanuric acid, or other suitable oxidizers capable of chemically attacking the dye in the garment. Applicants' unique gel composition is used to tumble with the fabric, during which tumbling the gel is smeared, by the random collisions of the garments with each other and the walls of the tumbler, and/or with a spreading agent, onto the garments. Where the gel contacts the garment, a degree of oxidizing or dye removal occurs.

To provide the proper consistency to the composition, applicants utilize a gelling or thickening agent which is typically derived from either organic or inorganic sources. Particularly useful as gelling agents in applicants' invention are natural smectite clays; such as magnesium aluminum silicates; and bentonire clays. A gel may be made in a variety of ways, but the gel used by applicants will typically substantially cling to a vertical surface and has a preferred viscosity range.

A gel is a two-phase colloid in which the disperse phase (solid) has combined with the continuous phase (liquid) to produce a viscous jelly-like product. The gel dispersion, typically of a solid and liquid may range from nearly liquid to the solid state, but is typically a semi-solid and of a jelly-like consistency, such as gelatin, mucilage, uncooked egg-white and the like.

Typically, gel solutions' viscosity depends upon their previous treatment. If the solution has been subject to large shear forces (such as being agitated or stirred rapidly), its fluidity is changed. But after some time, it returns to its former, more viscous condition. Gels also typically exhibit elasto-plastic deformation.

A great portion of the gel volume is typically occupied by a liquid (dispersion medium). Typically, the dispersed medium is a small percent of the liquid by both weight and volume of the gelling agent to the liquid. Often, where the liquid phase is water, it retains the ability to diffuse small molecules, such as a bleaching agent, throughout the liquid component without reacting to the gelling agent.

Here, applicants use the oxidizing agent and gelling agent to produce a gel composition that when tumbled either alone with garments or with a spreading medium such as cut up PVC pipe with garments to produce a distressed or faded look to the fabric.

That is, applicant' unique colloidal composition will substantially adhere to the fabric during the tumbling step. However, the composition, being viscous, will typically not, under its own impetus, flow into, around and under many cracks, crevices, seams, belt loops, into fabric seams around cuffs, pockets, zipper covers, flies, and the like found in the finished garment. The result is a random, worn, faded look with the amount and extent of fading typically being a function of among other things, random contacts of the garments and the composition which occur during tumbling. In contrast, a liquid oxidizing solution would typically flow around and under belt loops into fabric seams, around cuffs, pockets, zipper covers, flies, and the like.

DETAILED DESCRIPTION OF THE PREFERRED EMBODIMENT

The preferred composition of the present invention is a composition containing an oxidizing agent, typically in the liquid state, and a gelling or thickening agent. The preferred oxidizing agents are hypochlorites, chlorites, and permanganate oxidizers, and the preferred gelling agents are non-organic smectite clays, aluminum silicates, attapulgite clay, silicon dioxide, fumed silica, colloidal silicas, modified montmorillonite clay, and amorphous silica powder.

Among applicant' preferred gelling agents are the inorganic smectite clays such as VEEGUM® and VAN GEL®, products of the R. P. Vanderbilt Company, Inc., 30 Winfield St., Norwalk, Conn. 06855. Both VEEGUM® and VAN GEL® are complex colloidal magnesium aluminum silicates. VEEGUM® is used in some formulations as a suspending agent, emulsion stabilizer and viscosity modifier. It is supplied as an insoluble flake which forms colloidal dispersions in water. VAN GEL® is an industrial thickener and suspending agent developed for industrial and agricultural uses. It is supplied as a small flake which disperses in water easily with high shear mixing. A description of these and other properties of VEEGUM® and VAN GEL® may be found in a folder entitled, "Minerals and Chemicals For Industry From The Specialties Department of R. T. Vanderbilt Company, Inc." #786 available from Vanderbilt. Gelulite, lapitonite (synthetic clay), bentolites, mineral colloid, asterben (sodium bentonite) are other gelling agents—all available from Southern Clay, Inc.

VEEGUM® and VAN GEL® have heretofore been used in the development of new household and institutional cleaning products for applications including basin, tub and tile, oven and grill, rug, toilet bowl cleaners, and paint and varnish removers, in part because they have excellent resistance to attack and degradation by strong acids, bases, and oxidizing agents. VEEGUM® and VAN GEL® are not soluble in water but can be dispersed in water to form a colloidal structure similar to a "house of cards". The colloidal "house of cards" structure accounts for the ability of these compositions to thicken and develop yield value in the products which they are contained. Yield value provides a vertical surface cling to the formulations while thickening provides different pouring and flow properties.

The blending order of the ingredients is, typically, mixing water and the thickening or the gelling agent, here preferably VEEGUM®, VAN GEL®, or Bentonite WH. Some gelling or thickening will be seen to occur after several minutes of stirring. Following the blending of the water and the gelling or thickening agent, solid potassium manganate (oxidizer) is added as well as any stabilizers or accelerators and continued mixing takes place until the desired viscosity is reached.

Stabilizers are used to slow down the deterioration of the activity of the bleach when chlorine-based oxidizers are used. Stabilizers include compositions such as soda ash added in about 4% by weight of the composition, which has been shown to help maintain chlorine activity while the composition is in storage and gives the composition more body.

It is found that certain ingredients added to the composition, such as sodium bicarbonate, accelerate the activity of the composition—that is, increases the effectiveness in achieving a given look in a faster period of time than utilizing the composition without such accelerators. Sodium bicarbonate is typically utilized as an accelerator, using about ½ to 2% by weight. When sodium bicarbonate is used as an accelerator, it also helps achieve an easier cleanup.

An additional component may be added to the gel composition to adjust the pH. For example, acetic acid has been found to be effective in reducing the pH of the gel composition when such reduction is called for. Altering the pH of the garment before it gets tumbled with the composition (such as in a prewash or pretreatment step) or altering the pH of the gel composition will affect the action of the oxidizer during tumbling.

Having discussed in general a typical blending order of the ingredients of applicant' unique composition, attention will now be turned to preparing a working batch. This particular batch was mixed in a steel tank, 160 gallon capacity with two 3-blade props, 16 inches in diameter, and driven by a ⅓ horsepower electric motor. One hundred thirty (130) gallons of water at 150° F. is provided, into which is mixed approximately 57 pounds of Bentonite WH as a gelling agent. This is mixed for approximately 1 hour in a lightning mixer. There will be some thickening of the water achieved, typically to approximately 1,000 cps or so.

About 17 pounds of dry sodium bicarbonate powder mixture is mixed in, the mixing continuing for about 15 minutes during which the composition thickens, typically to 1,500 to 2,000 cps.

Following the addition of sodium bicarbonate, potassium permanganate, the oxidizer (approximately 23 pounds) is added to the tank and mixed for about 25 minutes.

By varying the amount of gelling or thickening agent, the viscosity resulting from the mix will be preferably between 6,500 and 15,000 cps as measured in a 600 ml beaker at 72° F. using a Brookfield Model RD Viscometer with a No. 4 Spindle at 20 rpm. The general range of viscosities for applicant' two-phase suspension is between 3,000 and 35,000 cps.

The second, albeit smaller, working recipe utilizes a chlorine-based bleach and includes mixing 28.6 pounds of water at 150° F. with about 3.5 pounds of Bentonite WH and 1.4 pounds of powder soda ash. The oxidizer is dry calcium hypochlorite, 65% available chlorine and the mixture is then added together in the same order as set forth previously (first adding the water to the Bentonite WH to thicken it, followed by the addition of soda ash, then sodium hypochlorite). The mixture results in a composition having about 12,000 cps viscosity and 5.5% available chlorine. When using the chlorine-based oxidizer, the preferred activity of the composition is 0.10 percent to 6.5 percent available chlorine by weight.

Applicants' novel method consists of using the colloidal composition to tumble with a garment, with or without inert spreaders such as ¼" to 10" lengths of PVC pipe. Various strength compositions can be run with or without the spreaders for various times at various temperatures in a tumbler to produce slight differences in the faded look achieved.

The spreaders utilized should be nonreactive with the oxidizer. Typically, the composition is placed in the tumbler followed by the addition of the spreading agents which are then tumbled with the gel to coat the gel onto the spreading agents. Following this, the garments, having been prewashed or pretreated in ways known in the art, are inserted into a tumbler for the tumbling step, the step during which most of the oxidation and fading of the garments takes place.

The weight of each spreader is typically about 25 grams. Each spreader must be of sufficient weight or density or overcome adherence between the composition and the wall of the gel. That is, the gel may cause a very lightweight or low-density spreader to stick to the side of the tumbler rather than bounce around inside the tumbler. Preferably, the weight of the spreader is between 20 and 60 grams. Three-quarter inch diameter solid PVC rods 2–3 inches long weighing about 40 grams have been used successfully, as has 1-inch hollow PVC pipe 2–3 inches long weighing about 25 grams.

While the method and the composition, indeed the specifications of this application frequently referred to the treatment of garments and in particular, the treatment of cotton-based fabric such as denim, the method and compositions described and claimed herein are in no ways so limited. The methods and compositions may be used with fabric before that fabric is cut up and sewn into garments. The methods and compositions claimed also may apply to fabric other than cotton-based fabric, including but not limited wholly or partially synthetic fabrics and including fabrics that are combinations of synthetic and organic fibers.

Nor are the gelling or thickening agents intended to be limited to the specific embodiments set forth. Indeed, both organic and inorganic gelling agents have been disclosed and used in the compositions and methods set forth herein. The specifications and claims are intended to apply to combinations of gelling or thickening agents and oxidizers, regardless of their origin and nature.

It is preferable that the pH of applicant' composition be between 4 and 13. Stabilizing the viscosity between 6,500 and 15,000 c.p.s. seems to produce a more desired look. Applicants have observed the substantial loss of indigo dye from the seams below this range. Above this range, mottling or spottiness usually develops, which may be lessened using denser, heavier or different shaped spreaders.

Varying the viscosity, amount of gel or thickening agent, bleaching strength of the composition, and time a garment is run are the factors which alter the look of the garment. The thinner or less viscous the composition, typically the more penetration of the oxidizer into the garment and the greater the fade. Above about 15,000 c.p.s., the composition tends to sit on the surface without as much penetration into the fabric's dye. However, in applicant' preferred viscosity range, an almost complete white panel results while retaining much of the blue around the seams, belt loops, hip pockets, waist bands, and cuffs of a denim garment.

In the preferred method of treating the garments to produce a faded or worn look, a tumbler is provided in which a gel composition containing an oxidizing gel or thickening agent is placed in the tumbler. The garments are then placed into the tumbler with the gel composition and tumbled for a period of time sufficient to produce the desired look. The garments are then removed from the tumbler and washed to remove the neutralized gel composition. The spreading agents may be added either before or after placing the gel composition in the tumbler, preferably before and tumbled for a time sufficient to coat the gel.

Preferred spreading agents include: plastic pipes, golf balls, rubber blocks, cylinders, and rubber hoses. The range of time of the tumbling step is generally between 15 seconds to 45 minutes, preferably between 6 and 15 minutes. The ratio of the weight of the gel composition to the weight of the garment is generally in the range of 0.01:1 to 5:1, preferably in the range of from 1.5:1 to 2.5:1. The general range of gelling agent is typically 1 to 50% by weight of said composition.

Clean-up of bleach-based oxidizers is easier than clean-up for potassium permanganate-based oxidizers. Compared to known art for cleaning up potassium permanganate-treated garments, for example, acid-wash garments which require 1–3 neutralization baths with intermediate scours or after-scours, the clean-up of applicant' garments, following treatment with the preferred composition and preferred method, utilizes typically 5 neutralization baths. These baths will be run in a liquid bath at about 5–10:1 weight ratio of water to fabric at about 160° F. with an effective amount of antichlor added for about 5 minutes each. The antichlor should be an amount sufficient to neutralize the oxidizer as the oxidizer moves from the garment into the neutralizing bath solution. The following recipe assumes about 160 pounds of denim garments coming out of the tumbler after tumbling with the potassium permanganate-based gel composition.

The first clean-up step is to immerse the garments in the neutralization bath. This step is followed by a second neutralization bath which is then followed by a third step of extraction for about 3 minutes at high speed. The fourth step includes another neutralization bath followed by step five, a scour, the scour utilizing a 1 to 2% by weight of caustic soda and a 1–2% by weight of goods peroxide mix in water at 160° F. for about 5 minutes. The sixth step is another neutralization bath. The seventh step is a cold bleach step. In this step, a chloride-based bleach, for example, 4.5 gallons of sodium hypochlorite (15% activity) and 200 gallons of water is utilized at about 90° F. to oxidize any remaining indigo on the surface of the garment. The amount of bleach may be varied depending upon the extent of the remaining indigo. The eighth step (following the cold bleach step) includes another neutralization. Following this neutralization is a whitening scour step, the whitening scour including a substantially stronger scour composition than typically used in clean-up, the scour composition made of about 3% by weight caustic soda and 15–20% by weight of peroxide including about ¼% optical brightener in 160° F. for 15–20 minutes. This ninth step is followed by a tenth and eleventh step of neutralization and extraction.

Compared to known clean-up in the art, applicant' clean-up steps are more extensive, with substantially more neutralization steps and unique cold bleach and whitening scour steps. In addition to the above steps, garments may be extracted before, during or after any of the neutralization steps to help remove oxidizer from the garments.

In addition, antiredeposition chemicals such as Ocean Wash® DL or Ocean Wash® LS may be utilized after and/or during the neutralization process to prevent redeposition of removed indigo dye on the garment.

It is intended that tumbling be understood to mean the use, as well as tumblers known in the art, of brushes, rollers or shakers or different types, or in fact the use of a manual or automated spreader to spread the thickening agent or gel onto the garment, or even the use of spraying the novel composition, under pressure, onto the garments to be treated.

Terms such as "left," "right," "up," "down," "bottom," "top," "front," "back," "in," "out," and like are applicable to the embodiments shown and described in conjunction with the drawings. These terms are merely for purposes of description and do not necessarily apply to the position or manner in which the invention may be constructed for use.

Although the invention has been described in connection with the preferred embodiment, it is not intended to limit the invention's particular form set forth, but on the contrary, it is intended to cover such alternatives, modifications, and equivalences that may be included in the spirit and scope of the invention as defined by the appended claims.

What is claimed is:

1. A method of treating garments or fabric to produce a faded or worn look, wherein the method comprises the steps of:

a. providing a tumbler;

b. placing a gel composition containing an oxidizing agent and a gelling agent in said tumbler wherein said gelling agent is from 1 to 50 percent by weight of said gel composition and said gelling agent is selected from magnesium aluminum silicates, bentonite clays, non-organic smectite clays, attapulgite clays, silicon dioxide, fumed silica, colloidal silicas, modified montmorillonite clay or amorphous silica powder;

c. placing a multiplicity of spreading agents into said tumbler, said spreading agents being nonreactive with the oxidizing agent and being selected from plastic pipes, golf balls, rubber blocks or rubber hoses;

d. placing the garments or fabric into said tumbler;

e. tumbling said garments or fabric, said multiplicity of spreading agents, and said gel composition for a period of time sufficient to produce said faded or worn look on said garments or fabric;

f. removing the garments or fabric from the tumbler; and g. washing the removed garments or fabric to remove and neutralize the gel composition.

2. The method of claim 1, wherein said multiplicity of spreading agents is placed into the tumbler before said step of placing the gel composition into the tumbler.

3. The method of claim 1, wherein said multiplicity of spreading agents is placed into the tumbler after said step of placing the garments or fabric in the tumbler.

4. The method of claim 1 wherein the time period of said tumbling step is between 15 seconds and 45 minutes.

5. The method of claim 1 wherein the ratio of the weight of said gel composition to the weight of said garments or fabric is in a range from 0.01:1 to 5:1.

6. The method of claim 1 wherein the ratio of the weight of said gel composition to the weight of said garments or fabric is in a range from 1.5:1 to 2.5:1.

7. The method of claim 1 wherein the oxidizing agent does not react with the gelling agent.

8. The method of claim 1 wherein said oxidizing agent is selected from the group consisting of potassium permanganate, sodium hypochlorite, sodium chlorate, sodium chlorite, sodium permanganate, calcium hypochlorite, lithium hypochlorite, and dichloroisocyanuric acid.

9. The method of claim 1, wherein said gel composition has a viscosity in the range of 3,000 to 35,000 c.p.s at 72° F. measured with a Brookfield viscometer at 20 rpm.

10. The method of claim 1, wherein said gel composition has a viscosity in the range of 6,500 to 15,000 c.p.s at 72° F. measured with a Brookfield viscometer at 20 rpm.

11. The method of claim 1, wherein said gel composition has a pH in the range of 4 to 12.

12. The method of claim 1, wherein the gel composition includes an accelerating agent.

13. The method of claim 1, wherein the gel composition includes a stabilizer.

* * * * *